US008142142B2

(12) United States Patent
Zborovsky et al.

(10) Patent No.: US 8,142,142 B2
(45) Date of Patent: Mar. 27, 2012

(54) TURBINE TRANSITION DUCT APPARATUS

(75) Inventors: James M. Zborovsky, Orlando, FL (US); Andreas J. Heilos, Muelheim an der Ruhr (DE)

(73) Assignee: Siemens Energy, Inc., Orlando, FL (US)

( * ) Notice: Subject to any disclaimer, the term of this patent is extended or adjusted under 35 U.S.C. 154(b) by 845 days.

(21) Appl. No.: 12/205,278

(22) Filed: Sep. 5, 2008

(65) Prior Publication Data

US 2010/0061837 A1 Mar. 11, 2010

(51) Int. Cl.
*F01D 11/00* (2006.01)

(52) U.S. Cl. ..... 415/185; 415/208.2; 415/211.2; 415/214.1; 60/39.37; 60/752; 60/760

(58) Field of Classification Search ..... 60/30.37, 60/752, 760; 415/185, 135, 138, 139, 208.2, 415/211.2, 214.1
See application file for complete search history.

(56) References Cited

U.S. PATENT DOCUMENTS

| | | | | |
|---|---|---|---|---|
| 5,125,796 | A | 6/1992 | Cromer | |
| 5,265,412 | A * | 11/1993 | Bagepalli et al. | 60/800 |
| 5,868,398 | A * | 2/1999 | Maier et al. | 277/643 |
| 6,345,494 | B1 | 2/2002 | Coslow | |
| 6,450,762 | B1 | 9/2002 | Munshi | |
| 6,675,584 | B1 * | 1/2004 | Hollis et al. | 60/796 |
| 6,733,234 | B2 | 5/2004 | Paprotna et al. | |
| 7,090,224 | B2 * | 8/2006 | Iguchi et al. | 277/603 |
| 7,097,423 | B2 * | 8/2006 | Burdgick | 415/173.7 |
| 7,870,738 | B2 * | 1/2011 | Zborovsky et al. | 60/752 |
| 7,901,186 | B2 * | 3/2011 | Cornett et al. | 416/198 A |
| 2005/0082768 | A1 | 4/2005 | Iguchi et al. | |
| 2006/0185345 | A1 | 8/2006 | Wilson et al. | |
| 2008/0053107 | A1 * | 3/2008 | Weaver et al. | 60/800 |
| 2008/0087020 | A1 | 4/2008 | Hsu et al. | |

FOREIGN PATENT DOCUMENTS

| | | |
|---|---|---|
| EP | 1918549 A1 | 5/2008 |
| EP | 1566521 A1 | 8/2008 |

OTHER PUBLICATIONS

U.S. Appl. No. 12/198,413-entitled Gas Turbine Transition Duct Apparatus.

Mahmut F. Aksit, et al.; High Performance Combustor Cloth Seals; 36th AIAA/ASME/SAE/ASEE Joint Propulsion Conference and Exhibit; Copyright 2000; p. 2; AIAA-00-3510; The American Institute of Aeronautics and Astronautics Inc.

* cited by examiner

*Primary Examiner* — Benjamin Sandvik
*Assistant Examiner* — Krista Soderholm

(57) ABSTRACT

A gas turbine transition duct apparatus is provided comprising first and second turbine transition ducts and a strip seal. The strip seal may comprise a sealing element and a spring structure.

20 Claims, 8 Drawing Sheets

TURBINE TRANSITION DUCT APPARATUS

FIELD OF THE INVENTION

The present invention is directed to a gas turbine transition duct apparatus comprising first and second transition ducts and a strip seal.

BACKGROUND OF THE INVENTION

A conventional combustible gas turbine engine includes a compressor, a combustor, including a plurality of combustor units, and a turbine. The compressor compresses ambient air. The combustor units combine the compressed air with a fuel and ignite the mixture creating combustion products defining a working gas. The working gases are routed to the turbine inside a plurality of transition ducts. Within the turbine are a series of rows of stationary vanes and rotating blades. The rotating blades are coupled to a shaft and disc assembly. As the working gases expand through the turbine, the working gases cause the blades, and therefore the disc assembly, to rotate.

Each transition duct may comprise a generally tubular main body and a collar coupled to an exit of the main body. The transition ducts may be positioned adjacent to one another within a circular array. The transition duct collars connect to a turbine inlet. For optimal performance, preferably only combustion gases enter the turbine inlet. The ducts may include brush seals as shown, for example, in U.S. Pat. No. 5,265,412, seal strips as shown, for example, in U.S. Pat. No. 7,090,224 or labyrinth seals as shown, for example, in U.S. Pat. No. 6,345,494, so as to prevent or limit cool compressed gases from entering into the turbine inlet.

SUMMARY OF THE INVENTION

In accordance with a first aspect of the present invention, a gas turbine transition duct apparatus is provided comprising first and second turbine transition ducts and a strip seal. The first turbine transition duct comprises a first generally tubular main body having first and second ends and a first collar coupled to the main body second end. The first collar has a first upper portion, a first lower portion and first side portions. One of the first side portions may have a first recess. A second turbine transition duct comprises a second generally tubular main body having third and fourth ends and a second collar coupled to the main body fourth end. The second collar has a second upper portion, a second lower portion and second side portions. One of the second side portions may have a second recess. The one first side portion may be positioned adjacent to the one second side portion such that the first and second recesses are located adjacent to one another. The first and second recesses may define a first slot. The strip seal may be positioned in the first slot and comprise a sealing element and a spring structure. The spring structure applies axial forces upon the one first side portion, the one second side portion and the sealing plate.

The outer edges of the strip seal may be received in the first and second recesses such that the first and second recesses axially locate the strip seal relative to the first and second transition ducts.

The spring structure may comprise an elongated wave spring having a first length. The elongated wave spring may be formed from a nickel-based superalloy, a cobalt-based superalloy, or Haynes 230.

The sealing element may comprise an elongated sealing plate having a second length greater than the first length of the wave spring.

The sealing element may further comprise retention tabs integral with the elongated sealing plate for engaging the wave spring and retaining the wave spring adjacent the elongated plate.

The elongated sealing plate may contain perforations through which compressed air passes to cool the elongated plate.

The elongated plate may be formed from a nickel-based superalloy, such as Inconel 600 series, a cobalt-based superalloy, Haynes 230, Haynes 188, or Hastelloy-X material.

The first and second recesses and/or the wave spring and the elongated sealing plate may be coated with a wear resistant coating. Alternatively, the first and second recesses may be lined with a consumable wear material such as clothmetal or fibermetal material. It is still further contemplated that the wave spring may be coated with a hard wear resistant coating and used in combination with the elongated sealing plate lined with a consumable wear material such as clothmetal or fibermetal material.

The first upper portion of the first collar may have a first upper recess and the second upper portion of the second collar may have a second upper recess. The gas turbine transition duct apparatus may further comprise a first seal structure positioned in the first and second upper recesses and positioned near or in contact with an upper end of the strip seal. Fasteners may be provided for passing through the first and second upper portions of the first and second collars and the first seal structure for securing the first seal structure to the first and second collars.

The first lower portion of the first collar may have a first lower recess and the second lower portion of the second collar may have a second lower recess. The gas turbine transition duct apparatus may further comprise a second seal structure positioned in the first and second lower recesses and in contact with a lower end of the strip seal.

In accordance with a second aspect of the present invention, a gas turbine transition duct apparatus is provided comprising first and second turbine transition ducts and a strip seal. The first turbine transition duct may comprise a first generally tubular main body having first and second ends and a first collar coupled to the main body second end. The first collar may have a first upper portion, a first lower portion and first side portions. One of the first side portions may have a first recess. The second turbine transition duct may comprise a second generally tubular main body having third and fourth ends and a second collar coupled to the main body fourth end. The second collar may have a second upper portion, a second lower portion and second side portions. One of the second side portions may have a second recess. The one first side portion may be positioned adjacent to the one second side portion such that the first and second recesses are located adjacent to one another. The first and second recesses may define a first slot. The strip seal may be positioned in the first slot and comprise a wave spring and a sealing element including sealing plate.

DETAILED DESCRIPTION OF THE INVENTION

Figure 1:
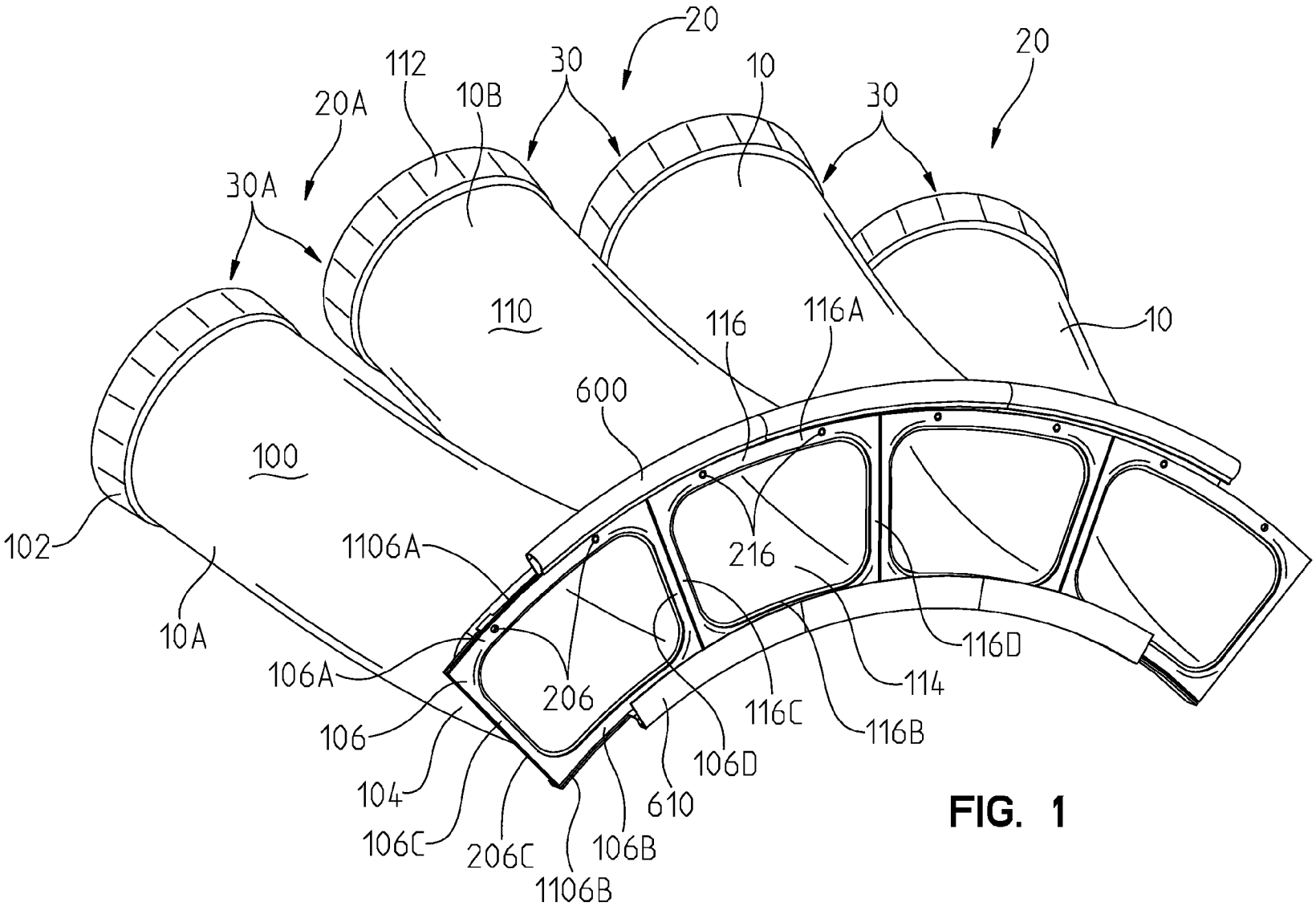
FIG. 1 is a perspective view of a plurality of gas turbine transition duct apparatuses constructed in accordance with the present invention.

A conventional combustible gas turbine engine (not shown) includes a compressor (not shown), a combustor (not shown), including a plurality of combustor units (not shown), and a turbine (not shown). The compressor compresses ambient air. The combustor units combine the compressed air with a fuel and ignite the mixture creating combustion products defining a working gas. The working gases are routed from the combustor units to an inlet (not shown) of the turbine inside a plurality of transition ducts 10, see FIGS. 1-2. The working gases expand in the turbine and cause blades coupled to a shaft and disc assembly to rotate.

In accordance with the present invention, a plurality of gas turbine transition duct apparatuses 20 are provided, each comprising an adjacent pair 30 of the transition ducts 10 and a strip seal 40. Each of the gas turbine transition duct apparatuses 20 may be constructed in the same manner. Hence, only a single gas turbine transition duct apparatus, labeled 20A in the drawings, will be described in detail herein.

Figure 2:
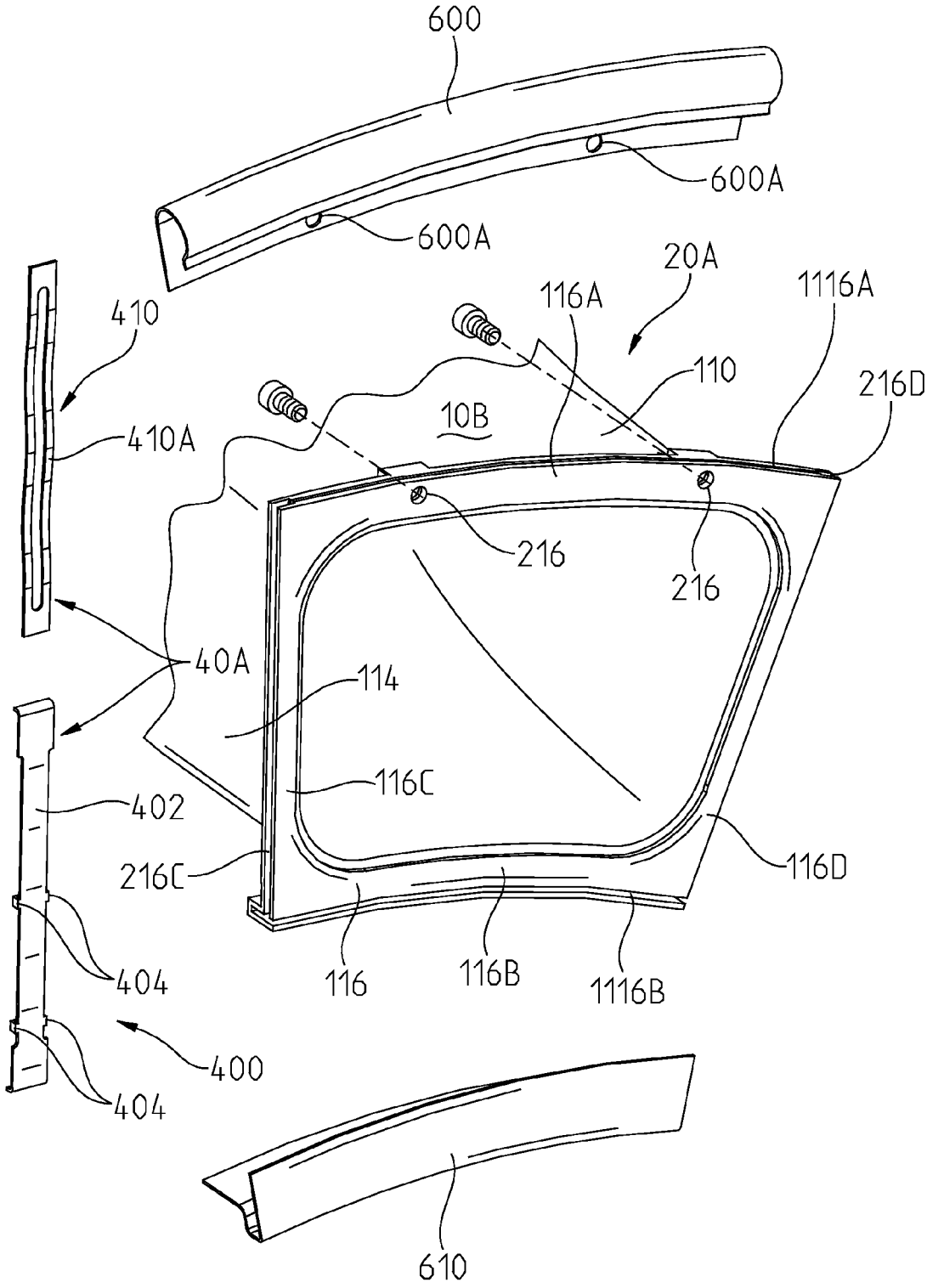
FIG. 2 is an exploded view of a portion of a gas turbine transition duct apparatus.

The gas turbine transition duct apparatus 20A comprises an adjacent transition duct pair 30A including a first transition duct 10A and a second transition duct 10B (only the second transition duct 10B is shown in FIG. 2). The gas turbine transition duct apparatus 20A further comprises a strip seal 40A, see FIG. 2.

The first turbine transition duct 10A comprises a first generally tubular main body 100 having first and second ends 102 and 104 and a first collar 106 coupled to the main body second end 104. The first collar 106 may be formed integrally with the first main body 100 or as a separate element which is welded to the first main body 100. The first collar 106 comprises a first upper portion 106A, a first lower portion 106B and first and second side portions 106C and 106D. The first side portion 106C is provided with a first recess 206C and the second side portion 106D is provided with a second recess 206D, see FIGS. 1, 5 and 6. In the illustrated embodiment, the first recess 206C extends generally along the entire length of the first side portion 106C, while the second recess 206D extends generally along the entire length of the second side portion 106D. The first tubular main body 100 and the first collar 106 may be formed from a nickel-based superalloy, such as Inconel 617, a cobalt-based superalloy or Haynes 230.

The second turbine transition duct 10B comprises a second generally tubular main body 110 having third and fourth ends 112 and 114 and a second collar 116 coupled to the main body fourth end 114. The second collar 116 may be formed integrally with the second main body 110 or as a separate element which is welded to the second main body 110. The second collar 116 comprises a second upper portion 116A, a second lower portion 116B and third and fourth side portions 116C and 116D. The third side portion 116C is provided with a third recess 216C and the fourth side portion 116D is provided with a fourth recess 216D, see FIGS. 1, 2 and 4-6. The third recess 216C may extend generally along the entire length of the third side portion 116C and the fourth recess may extend generally along the entire length of the fourth side portion 116C. The second tubular main body 110 and the second collar 116 may be formed from a nickel-based superalloy, such as Inconel 617, a cobalt-based superalloy or Haynes 230.

Figure 3:
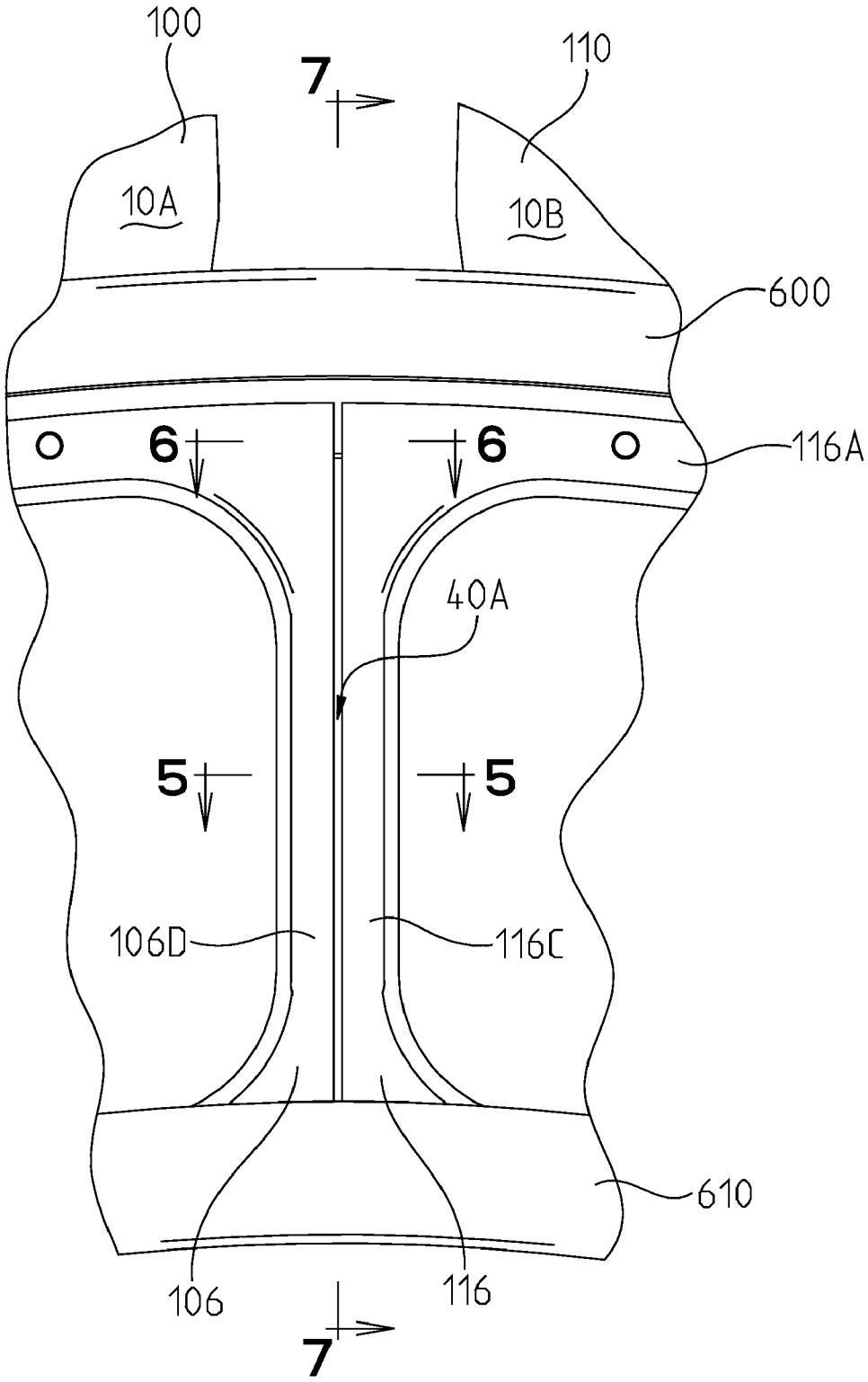
FIG. 3 is a view of a portion of a gas turbine transition duct apparatus.
Figure 4:
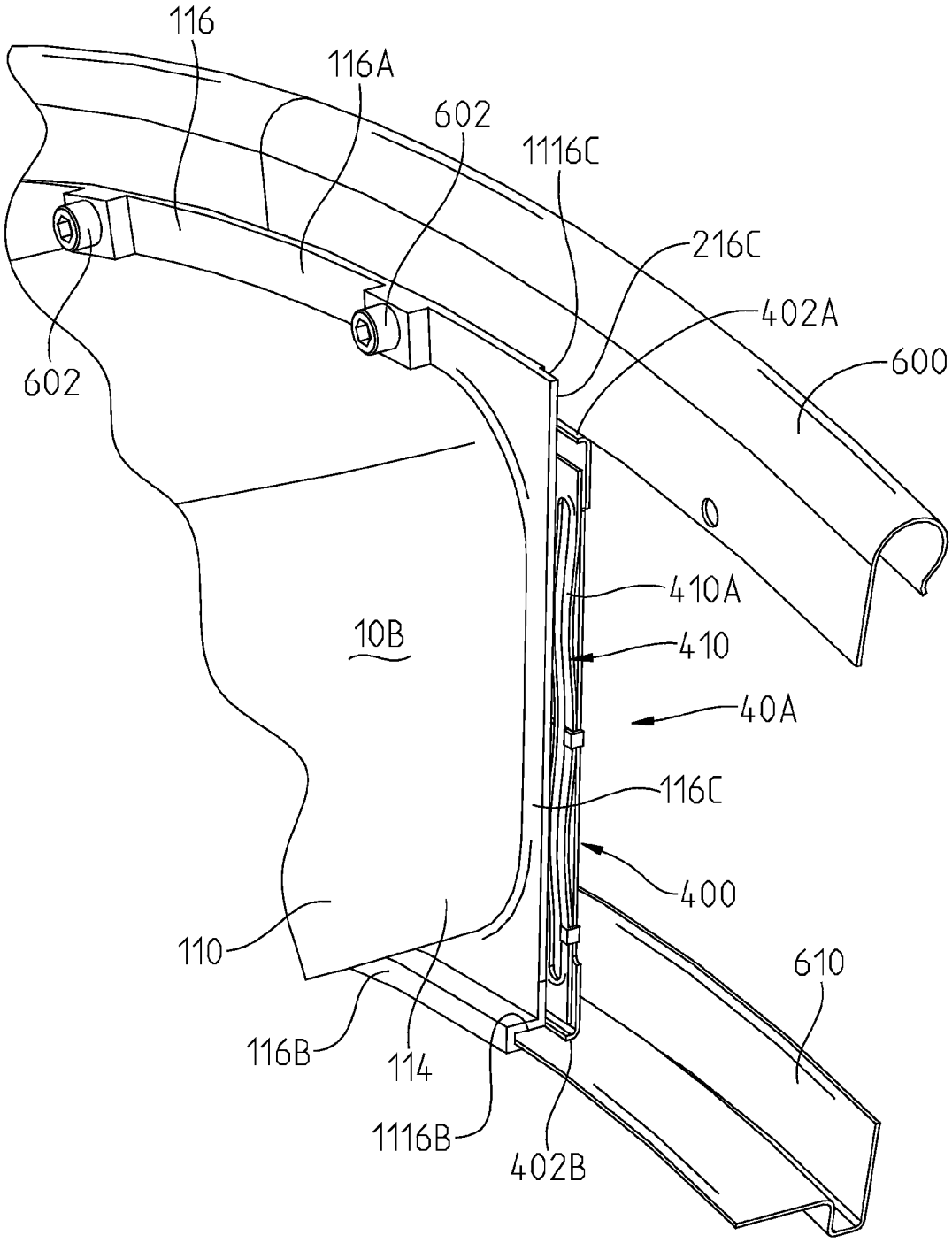
FIG. 4 is a perspective view of a portion of a gas turbine transition duct apparatus.
Figure 5:
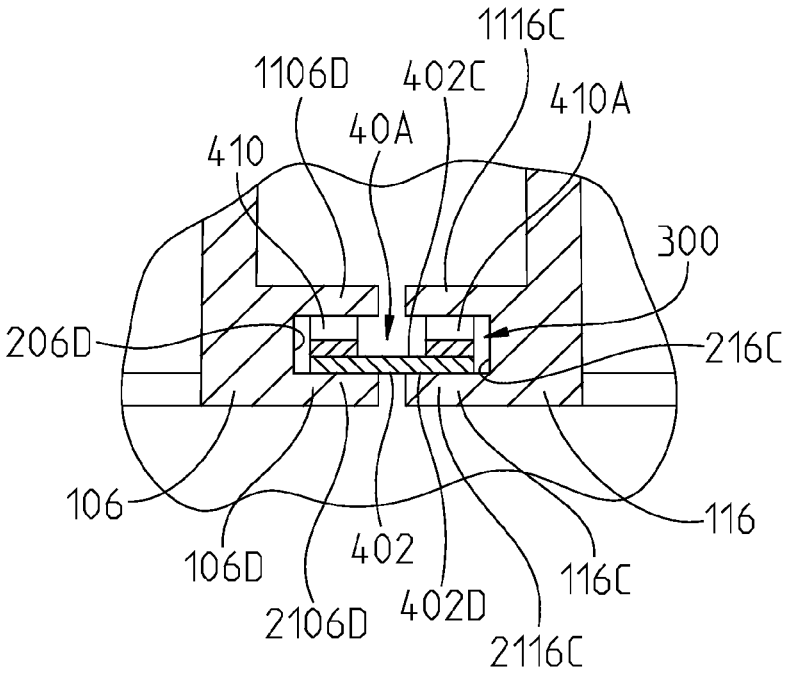
FIG. 5 is a view taken along view line 5-5 in FIG. 3.

The first collar second side portion 106D is located next to the second collar third side portion 116C, see FIGS. 1, 3 and 5, such that the second and third recesses 206D and 216C are located adjacent to one another. The second and third recesses 206D and 216C define a slot 300 between them, see FIGS. 5 and 6.

Figure 7:
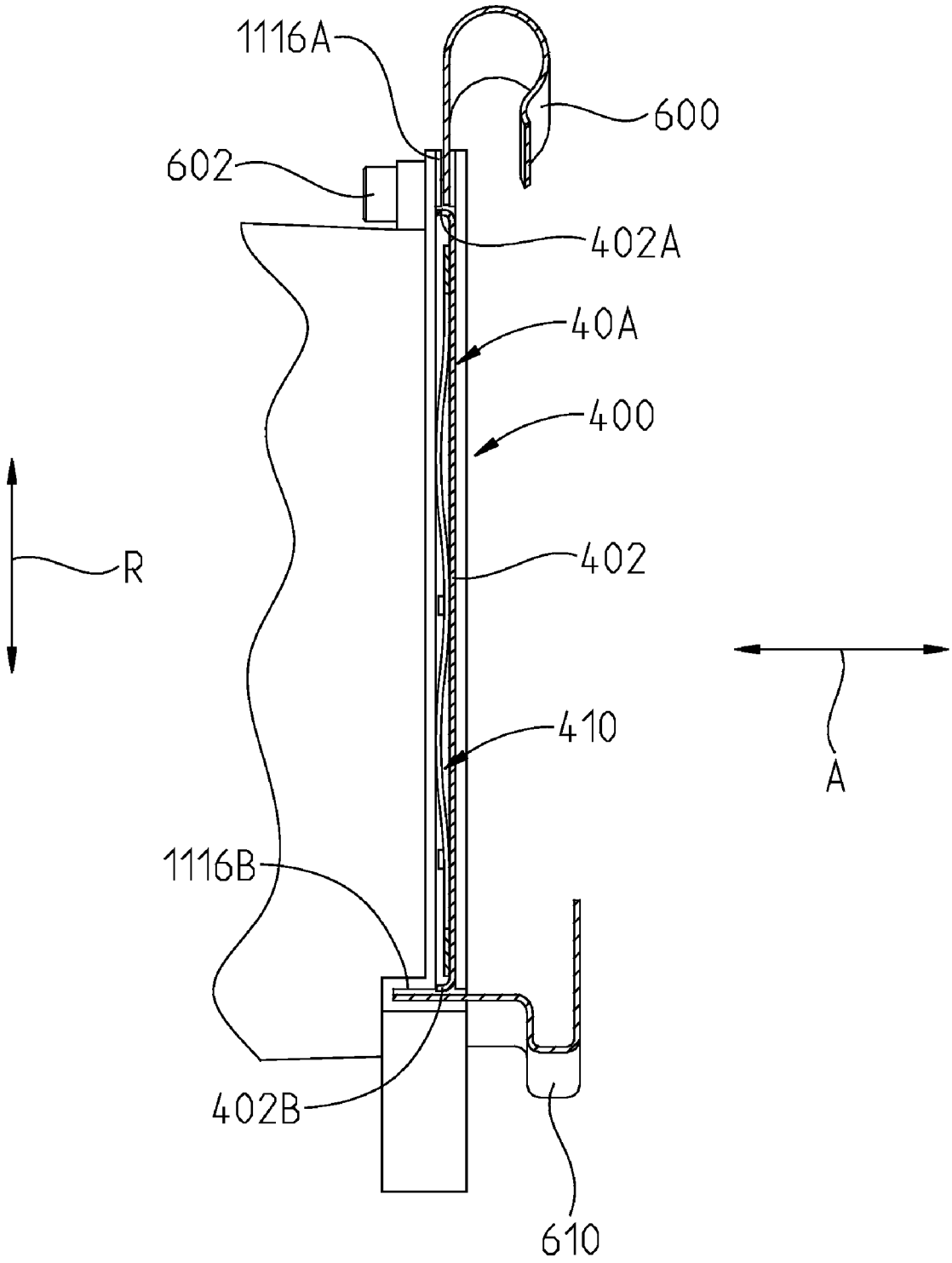
FIG. 7 is a view taken along view line 7-7 in FIG. 3.

The strip seal 40A comprises a sealing element 400 and a spring structure 410. The sealing element 400 comprises an elongated sealing plate 402 and integral tabs 404. The sealing plate 402 includes an upper L-shaped end 402A and a lower L-shaped end 402B, see FIG. 8. The spring structure 410 comprises an elongated wave spring 410A having a first length $L_1$, see FIG. 8. The sealing plate 402 has a length $L_2$ which is greater than length $L_1$, see FIG. 8. The wave spring 410A is held adjacent to the sealing plate 402 via the tabs 404, see FIG. 8. Because the sealing plate 402 has a length $L_2$ greater than the length $L_1$ of the wave spring 410A and the wave spring 410A is not fixed to the sealing plate 402 at the spring's two opposing ends, the wave spring 410A is permitted to expand radially, which radial direction is designated by arrow R in FIGS. 7 and 8, as it is compressed in an axial direction during radial insertion into the slot 300, which axial direction is designated by arrow A in FIGS. 7 and 8. The seal element 400 may be formed from a nickel-based superalloy, such as an Inconel Series 600 material, a cobalt-based superalloy, Haynes 230, Haynes 188, or Hastelloy-X material. The spring structure 410 may be formed from a nickel-based superalloy, Inconel X750, a cobalt-based superalloy, or Haynes 230.

It is contemplated that the wave spring 410A may be fixedly coupled at one end, such as at a lower end 1410A of the wave spring 410A, via spot welds 415 (shown only in FIG. 8) to the sealing plate 402. Preferably, the wave spring 410A is only spot welded at one end to the sealing plate 402 so as to allow the wave spring 410A to move/expand radially during insertion into the slot 300 and in response to other mechanical influences on the wave spring 410A such as resulting from vibrations occurring during gas turbine engine operation. Because the wave spring 410A is able to move radially relative to the sealing plate 402 in response to mechanical forces acting on the spring 410A in the radial direction R, e.g., vibration, little or no stresses are introduced into the wave spring 410A by those mechanical forces.

As noted previously, the strip seal 40A is inserted into the slot 300 defined by the second and third recesses 206D and 216C of the first collar second side portion 106D and the second collar third side portion 116C. Hence, outer edges of the strip seal 40A are received in the second and third recesses 206D and 216C such that the strip seal 40A is properly axially located relative to the first and second transition ducts 10A and 10B. When positioned in the slot 300, the strip seal 40A functions to block compressed air, generated by the compressor, from passing between the first and second collars 106 and 116 and entering the turbine inlet.

Figure 8:
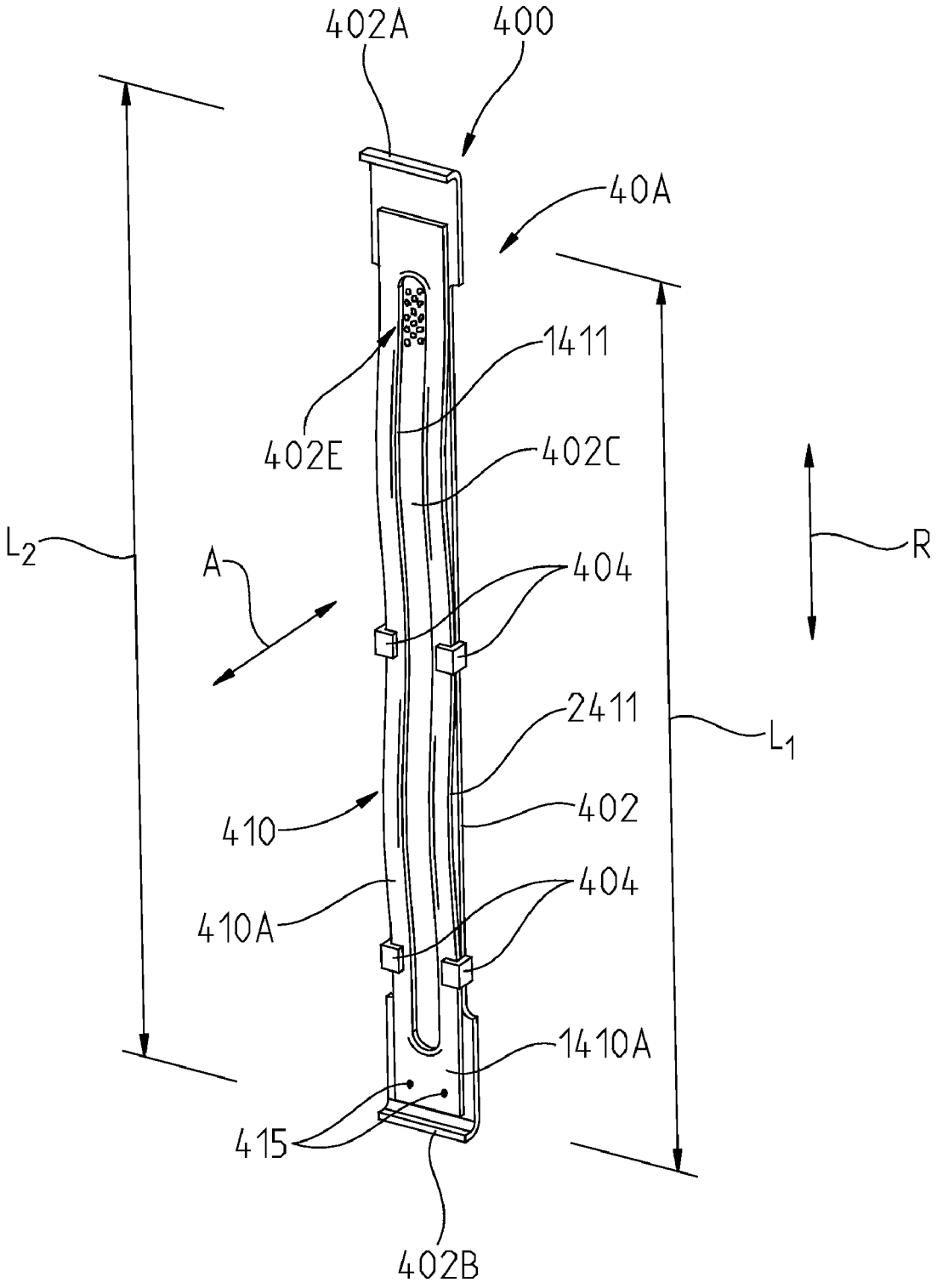
FIG. 8 is a perspective view of a strip seal of the present invention.

The wave spring 410A is sized so that when it is positioned in the slot 300, it applies axial forces, i.e., pushes outwardly, against inner flanges 1106D and 1116C of the first collar second side portion 106D and the second collar third side portion 116C as well as against and an inner surface 402C of the sealing plate 402, see FIGS. 5 and 8. The axial forces applied by the wave spring 410A against the sealing plate inner surface 402A causes an outer surface 402D of the sealing plate 402 to press against outer flanges 2106D and 2116C of the first collar second side portion 106D and the second collar third side portion 116C. The axial forces generated by the wave spring 410A result in the sealing plate 402 and, hence, the strip seal 40A, being mechanically held in position within the slot 300.

During operation of the gas turbine engine, the first and second collars 106 and 116 may move apart in the circumferential direction as their temperatures increase such that a gap between them may increase in the circumferential direction. It is preferred that each of the wave spring 410A and sealing plate 402 be sized so as to have a width extending in the circumferential direction sufficiently large to permit the wave spring 410A to always maintain contact with the inner flanges 1106D and 1116C of the first collar second side portion 106D and the second collar third side portion 116C and to permit the outer surface 402D of the sealing plate 402 to always engage with the outer flanges 2106D and 2116C of the first collar second side portion 106D and the second collar third side portion 116C when the gap between the first and second collars 106 and 116 in the circumferential direction is at a maximum value. It is also contemplated that the width of the sealing plate 402 including the upper and lower L-shaped ends 402A and 402B in the circumferential direction may be substantially equal to the width of the slot 300 in the circumferential direction at ambient temperature.

The elongated sealing plate 402 may contain small perforations 402E, shown only in FIG. 8, through which very small amounts of compressed air passes to cool the elongated plate 402. The wave spring 410A includes a centrally located, elongated opening 1411 through which compressed air passes through the wave spring 410A so as to enter and pass through the perforations 402E in the sealing plate 402. Compressed air passing through the opening 1411 may also contact and cool portions of a rear surface 2411 of the wave spring 410A, which portions are spaced away from the sealing plate 402, so as to further cool the wave spring 410A. The opening 1411 in the wave spring 410A also defines two separate legs of the wave spring 410A, wherein a first leg is received in the recess 206D and a second leg is received in the recess 216C. The separate legs are able to conform separately to differing shapes/sizes of the recesses 206D and 216C when the wave spring 410A is inserted into the slot 300.

Figure 9:
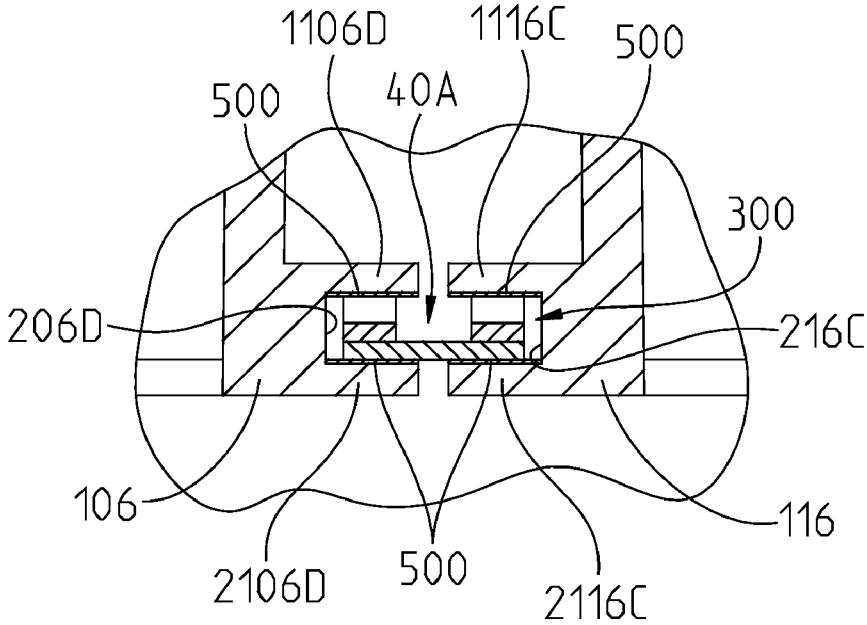
FIG. 9 is a view similar to FIG. 5 illustrating a wear resistant coating provided on inner and outer flanges defining second and third recesses of a first collar second side portion and a second collar third side portion.
Figure 10:
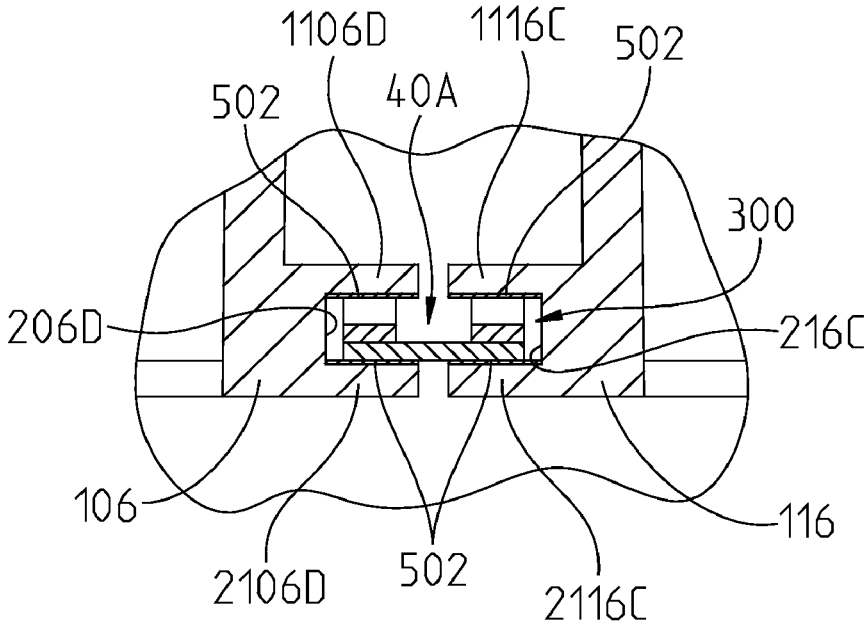
FIG. 10 is a view similar to FIG. 5 illustrating metallic layers provided on inner and outer flanges defining second and third recesses of a first collar second side portion and a second collar third side portion.

The inner and outer flanges 1106D, 1116C, 2106D and 2116C defining the second and third recesses 206D and 216C of the first collar second side portion 106D and the second collar third side portion 116C may be provided with a hard wear resistant coating 500, such as a nickel-chrome/chrome-carbide material, applied such as by an air plasma spray (APS) process, or T-800, commercially available from FW Gartner, Houston, Tex., applied such as by an air plasma spray (APS) process or a High Velocity Oxy Fuel (HVOF) process, so as to reduce wear of the inner and outer flanges 1106D, 1116C, 2106D and 2116C by the strip seal 40A, see FIG. 9.

Alternatively, the inner and outer flanges 1106D, 1116C, 2106D and 2116C defining the second and third recesses 206D and 216C of the first collar second side portion 106D and the second collar third side portion 116C may be lined with an abradable metallic layer 502, i.e., a consumable wear material, so as to reduce wear of the inner and outer flanges 1106D, 1116C, 2106D and 2116C as well as the strip seal 40A. Example metallic layer materials include fibermetal and clothmetal layers. Example fibermetal layers include Feltmetal material formed from Hastelloy-X material, Haynes 188 material, or FeCrAlY material. Feltmetal formed from these three materials is commercially available from Technetics Corporation, DeLand, Fla. Example clothmetal layers are commercially available from Cleveland Wire Cloth or Unique Wire Weaving. It is contemplated that the clothmetal layers may be made from Inconel 718 or Inconel X750.

It is still further contemplated that the surface of the wave spring 410A in engagement with the inner flanges 1106D and 1116C of the first collar second side portion 106D and the second collar third side portion 116C may be coated with a hard wear resistant coating, such as one of the hard wear resistant coatings listed above, and the outer surface 402D of the sealing plate 402 in engagement with the outer flanges 2106D and 2116C of the first collar second side portion 106D and the second collar third side portion 116C may be coated with a hard wear resistant coating, such as one of the hard wear resistant coatings listed above or lined with one of the metallic layers noted above.

Figure 6:
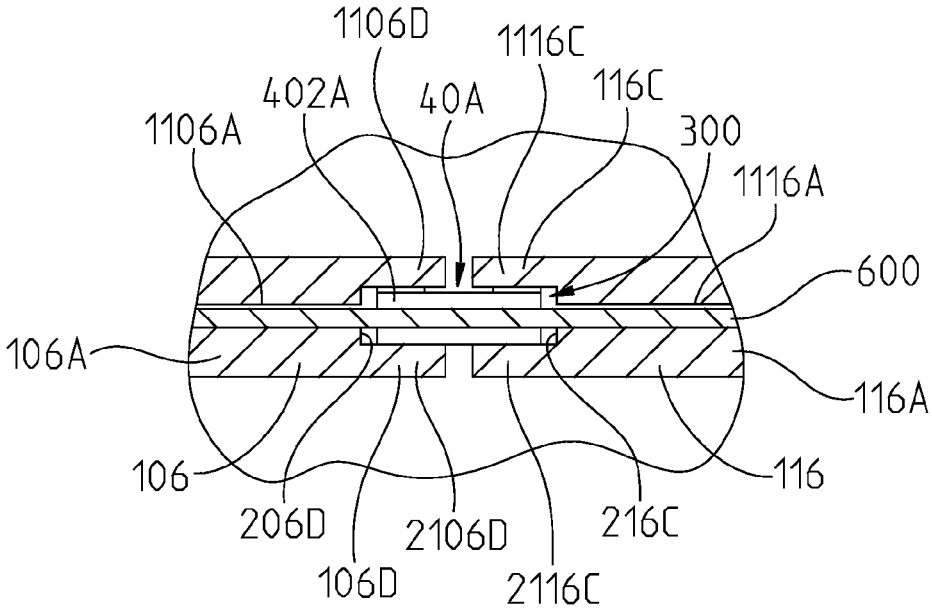
FIG. 6 is a view taken along view line 6-6 in FIG. 3.

The first upper portion 106A of the first collar 106 may have a first upper recess 1106A and the second upper portion 116A of the second collar 116 may have a second upper recess 1116A, see FIGS. 1, 2 and 6. In the illustrated embodiment, a first seal structure 600 is positioned in the first and second upper recesses 1106A and 1116A and positioned near or in contact with the upper L-shaped end 402A of the sealing plate 402. Fasteners 602 pass through bores 206, 216 (bores 206, 216 may be threaded) and 600A in the first and second upper portions 106A and 116A of the first and second collars 106 and 116 and the first seal structure 600 for securing the first seal structure 600 to the first and second collars 106 and 116, see FIGS. 1, 2 and 4. The first seal structure 600 functions to radially maintain the strip seal 40A in the slot 300.

The first lower portion 106B of the first collar 106 has a first lower recess 1106B and the second lower portion 116B of the second collar 116 has a second lower recess 1116B, see FIGS. 1, 2, 4 and 7. A second seal structure 610 is positioned and frictionally held in the first and second lower recesses 1106B and 1116B and may be in contact with the lower L-shaped end 402B of the sealing plate 402 so as to radially maintain the strip seal 40A in the slot 300.

In the illustrated embodiment, the strip seal 40A is inserted into the slot 300 after the second seal structure 610 is positioned in the first and second lower recesses 1106B and 1116B. Once the strip seal 40A has been inserted into the slot 300, the first seal structure 600 is inserted into the first and second upper recesses 1106A and 1116A.

It is further contemplated that the sealing plate 402 may be mechanically fixed to either the first collar second side portion 106D and the second collar third side portion 116C so as to reduce vibration of the strip seal 40A.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine transition duct apparatus comprising:

a first turbine transition duct comprising a first generally tubular main body having first and second ends, and a first collar coupled to said main body second end, said first collar having a first upper portion, a first lower portion and first side portions, one of said first side portions having a first recess;

a second turbine transition duct comprising a second generally tubular main body having third and fourth ends, and a second collar coupled to said main body fourth end, said second collar having a second upper portion, a second lower portion and second side portions, one of said second side portions having a second recess;

said one first side portion being positioned adjacent to said one second side portion such that said first and second recesses are located adjacent to one another, said first and second recesses defining a first slot; and a strip seal positioned in said first slot and comprising a sealing element and a spring structure, said spring structure applying axial forces upon said one first side portion, said one second side portion and said sealing element.

2. The gas turbine transition duct apparatus as set out in claim 1, wherein outer edges of said strip seal are received in said first and second recesses such that said first and second recesses axially locate said strip seal relative to said first and second transition ducts.

3. The gas turbine transition duct apparatus as set out in claim 1, wherein said spring structure comprises an elongated wave spring having a first length.

4. The gas turbine transition duct apparatus as set out in claim 3, wherein said elongated wave spring is formed from a nickel-based superalloy.

5. The gas turbine transition duct apparatus as set out in claim 3, wherein said sealing element comprises an elongated sealing plate having a second length greater than said first length of said wave spring.

6. The gas turbine transition duct apparatus as set out in claim 5, wherein said sealing element further comprises retention tabs integral with said elongated sealing plate for engaging said wave spring and retaining said wave spring adjacent said elongated plate.

7. The gas turbine transition duct apparatus as set out in claim 5, wherein said elongated sealing plate contains perforations through which compressed air passes to cool said elongated plate.

8. The gas turbine transition duct apparatus as set out in claim 5, wherein said elongated sealing plate is formed from a nickel-based superalloy.

9. The gas turbine transition duct apparatus as set out in claim 1, wherein said first and second recesses are coated with a wear resistant coating.

10. The gas turbine transition duct apparatus as set out in claim 1, wherein said first and second recesses are lined with a consumable wear material.

11. The gas turbine transition duct apparatus as set out in claim 1, wherein said first upper portion of said first collar has a first upper recess and said second upper portion of said second collar has a second upper recess and further comprising a first seal structure positioned in said first and second upper recesses and positioned near or in contact with an upper end of said strip seal.

12. The gas turbine transition duct apparatus as set out in claim 11, further comprising fasteners for passing through said first and second upper portions of said first and second collars and said first seal structure for securing said first seal structure to said first and second collars.

13. The gas turbine transition duct apparatus as set out in claim 1, wherein said first lower portion of said first collar has a first lower recess and said second lower portion of said second collar has a second lower recess and further comprising a second seal structure positioned in said first and second lower recesses and in contact with a lower end of said strip seal.

14. A gas turbine transition duct apparatus comprising:

a first turbine transition duct comprising a first generally tubular main body having first and second ends, and a first collar coupled to said main body second end, said first collar having a first upper portion, a first lower portion and first side portions, one of said first side portions having a first recess;

a second turbine transition duct comprising a second generally tubular main body having third and fourth ends, and a second collar coupled to said main body fourth end, said second collar having a second upper portion, a second lower portion and second side portions, one of said second side portions having a second recess;

said one first side portion being positioned adjacent to said one second side portion such that said first and second recesses are located adjacent to one another, said first and second recesses defining a first slot; and a strip seal positioned in said first slot and comprising a wave spring and a sealing element including sealing plate.

15. The gas turbine transition duct apparatus as set out in claim 14, wherein said sealing element further comprises retention tabs integral with said sealing plate for engaging said wave spring and retaining said wave spring adjacent said sealing plate.

16. The gas turbine transition duct apparatus as set out in claim 14, wherein said first and second recesses are at least one of: coated with a wear resistant coating, and lined with a consumable wear material.

17. The gas turbine transition duct apparatus as set out in claim 14, wherein said first upper portion of said first collar has a first upper recess and said second upper portion of said second collar has a second upper recess and further comprising a first seal structure positioned in said first and second upper recesses and positioned near or in contact with an upper end of said strip seal.

18. The gas turbine transition duct apparatus as set out in claim 14, wherein said first lower portion of said first collar has a first lower recess and said second lower portion of said second collar has a second lower recess and further comprising a second seal structure positioned in said first and second lower recesses and in contact with a lower end of said strip seal.

19. The gas turbine transition duct apparatus as set out in claim 14, wherein outer edges of said strip seal are received in said first and second recesses such that said first and second recesses axially locate said strip seal relative to said first and second transition ducts.

20. The gas turbine transition duct apparatus as set out in claim 14, wherein said wave spring applies axial forces upon said one first side portion, said one second side portion and said sealing plate.

* * * * *